US007031633B2

(12) United States Patent
Regan et al.

(10) Patent No.: US 7,031,633 B2
(45) Date of Patent: Apr. 18, 2006

(54) PRINTING APPARATUS AND METHOD WITH IMPROVED CONTROL OF HUMIDITY AND TEMPERATURE

(75) Inventors: Michael T. Regan, Fairport, NY (US); Robert M. Peffer, Penfield, NY (US)

(73) Assignee: Eastman Kodak Company, Rochester, NY (US)

( * ) Notice: Subject to any disclaimer, the term of this patent is extended or adjusted under 35 U.S.C. 154(b) by 128 days.

(21) Appl. No.: 10/721,121

(22) Filed: Nov. 25, 2003

(65) Prior Publication Data

US 2005/0111873 A1 May 26, 2005

(51) Int. Cl.
*G03G 21/20* (2006.01)

(52) U.S. Cl. ..... 399/94; 399/97; 399/98

(58) Field of Classification Search ..... 399/91, 399/92, 93, 94, 97, 98
See application file for complete search history.

(56) References Cited

U.S. PATENT DOCUMENTS

| | | | | |
|---|---|---|---|---|
| 3,814,516 | A | 6/1974 | Whited | |
| 5,028,954 | A * | 7/1991 | Yamamoto et al. | 355/401 |
| 5,231,418 | A * | 7/1993 | Inui et al. | 347/187 |
| 5,291,253 | A | 3/1994 | Kumasaka et al. | |
| 5,920,751 | A | 7/1999 | Chow et al. | |
| 6,185,382 | B1 | 2/2001 | Knott et al. | |
| 6,227,643 | B1 | 5/2001 | Purcell et al. | |

FOREIGN PATENT DOCUMENTS

| | | |
|---|---|---|
| JP | 1988-32476 | 11/1994 |
| JP | 1991-216091 | 12/1996 |
| JP | 1990-184572 | 3/1997 |
| JP | 2000-156037 | 12/2001 |
| WO | 9910778 | 3/1999 |

* cited by examiner

*Primary Examiner*—Hoan Tran
(74) *Attorney, Agent, or Firm*—NormanRushefsky

(57) ABSTRACT

A method and apparatus for controlling conditions in a printer that includes a print engine that is operative upon an article to print marks upon the article. Sensors are provided for detecting relative humidity and temperature within a moving air stream in the printer. A controller in the printer determines if the detected relative humidity within the apparatus falls within a range of acceptable relative humidities and the detected temperature within the apparatus falls within a range of acceptable temperatures. The range of acceptable relative humidities and acceptable temperatures defines a predetermined target area. When outside the range of the predetermined target area a determination is made of needed minimal adjustments to bring the temperature and humidity within the target area. Subject to such a determination, mist and/or heating of the air stream are provided to implement the needed adjustments.

5 Claims, 5 Drawing Sheets

PRINTING APPARATUS AND METHOD WITH IMPROVED CONTROL OF HUMIDITY AND TEMPERATURE

CROSS REFERENCE TO RELATED APPLICATIONS

This application is related to U.S. application Ser. No. 10/721,975, filed on Nov. 25, 2003, in the names of Robert M. Peffer et al., entitled: PRINTING APPARATUS AND METHOD WITH IMPROVED CONTROL OF AIRFLOW.

FIELD OF THE INVENTION

The present invention relates to printer or copier apparatus and methods and more particularly to the control of temperature and humidity in the apparatus.

BACKGROUND OF THE INVENTION

In printing apparatus generally and more particularly of interest to electrophotography or xerography, there is a need to provide control of temperature and humidity within the copier or printer machine in order to provide for optimum performance and ensure image quality. Heretofore, control of temperature and/or humidity was provided by employing individual sensors for each of humidity and temperature in the machine and controlling temperature of the certain component that was particularly critical, such as a photoconductor or xerographic imaging drum or belt, and controlling humidity at a different locations such as at the development station. Each is controlled to a particular set point. A problem with such an approach is that it is relatively energy inefficient and thus increases cost of production and operation of the machine. The other large printing machines employ expensive refrigeration units, which also adds to the cost and energy use of the machine.

SUMMARY OF THE INVENTION

The invention is directed to a low-cost solution for control of temperature and humidity in a printer. In accordance with a first aspect of the invention there is provided a printer apparatus comprising a print engine that is operative upon an article to be printed to impart markings upon the article; a sensor for detecting humidity within the printer apparatus; a sensor for detecting temperature within the printer apparatus; and a controller for determining if the detected humidity within the apparatus falls within a range of acceptable humidities and the detected temperature within the apparatus falls within a range of acceptable temperatures wherein the range of acceptable humidities and acceptable temperatures defines an area of set points of acceptable humidities and temperatures.

In accordance with a second aspect of the invention, there is provided a method of controlling conditions in a printer apparatus that includes a print engine that is operative upon an article to print marks upon the article, the method comprising detecting humidity within the printer apparatus; detecting temperature within the printer apparatus; and determining if the detected humidity within the apparatus falls within a range of acceptable humidities and the detected temperature within the apparatus falls within a range of acceptable temperatures wherein the range of acceptable humidities and acceptable temperatures defines an area of set points of acceptable humidities and temperatures.

BRIEF DESCRIPTION OF THE DRAWINGS

Other objects and advantages will become apparent upon reading the following detailed description and upon reference to the drawings, in which.

While the present invention will be described in connection with regard to preferred embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE INVENTION

Figure 1:
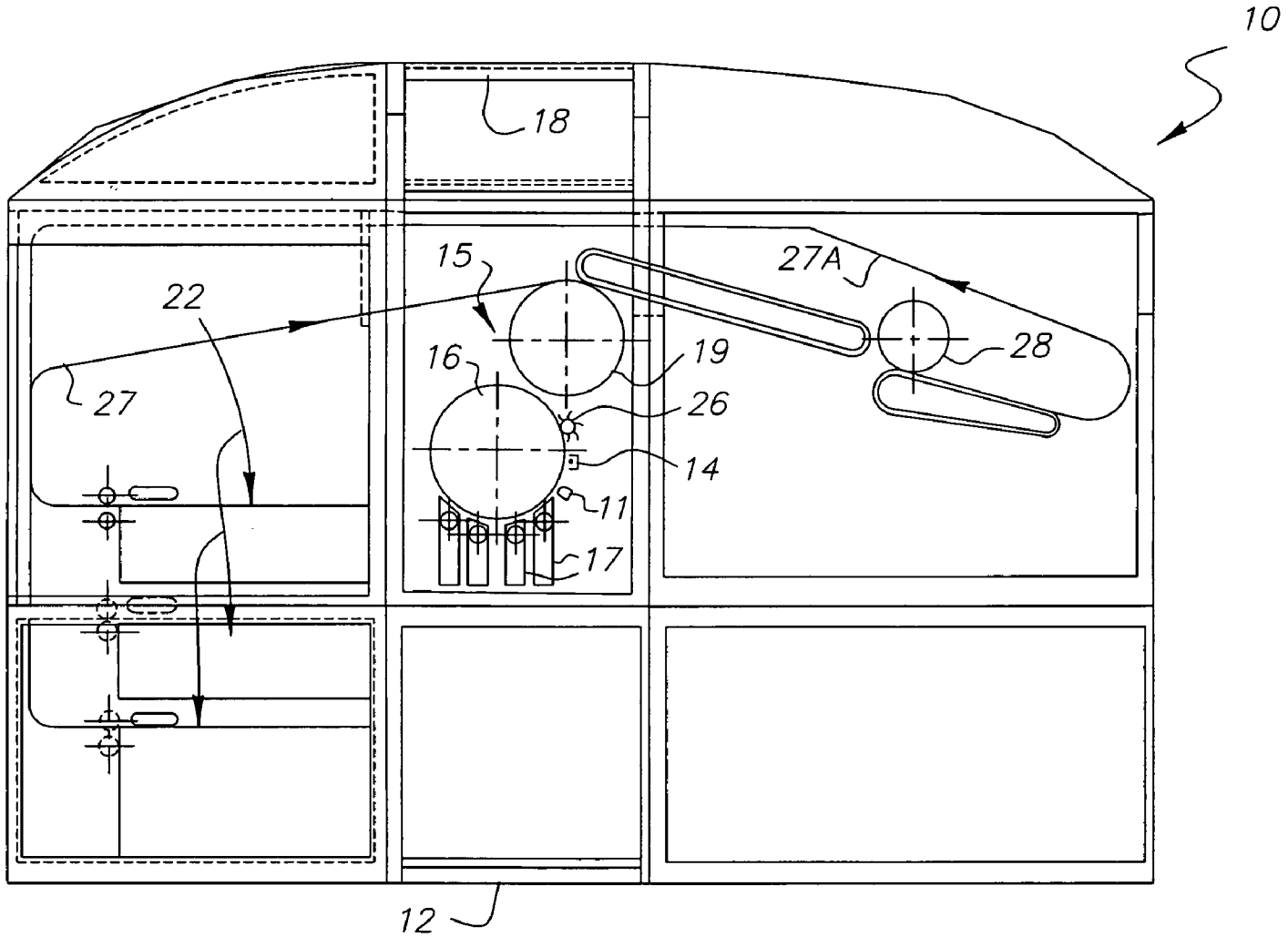
FIG. 1 is a front elevation view of a xerographic or electrophotographic printer apparatus or machine that includes the inventive features of the invention.
Figure 2:
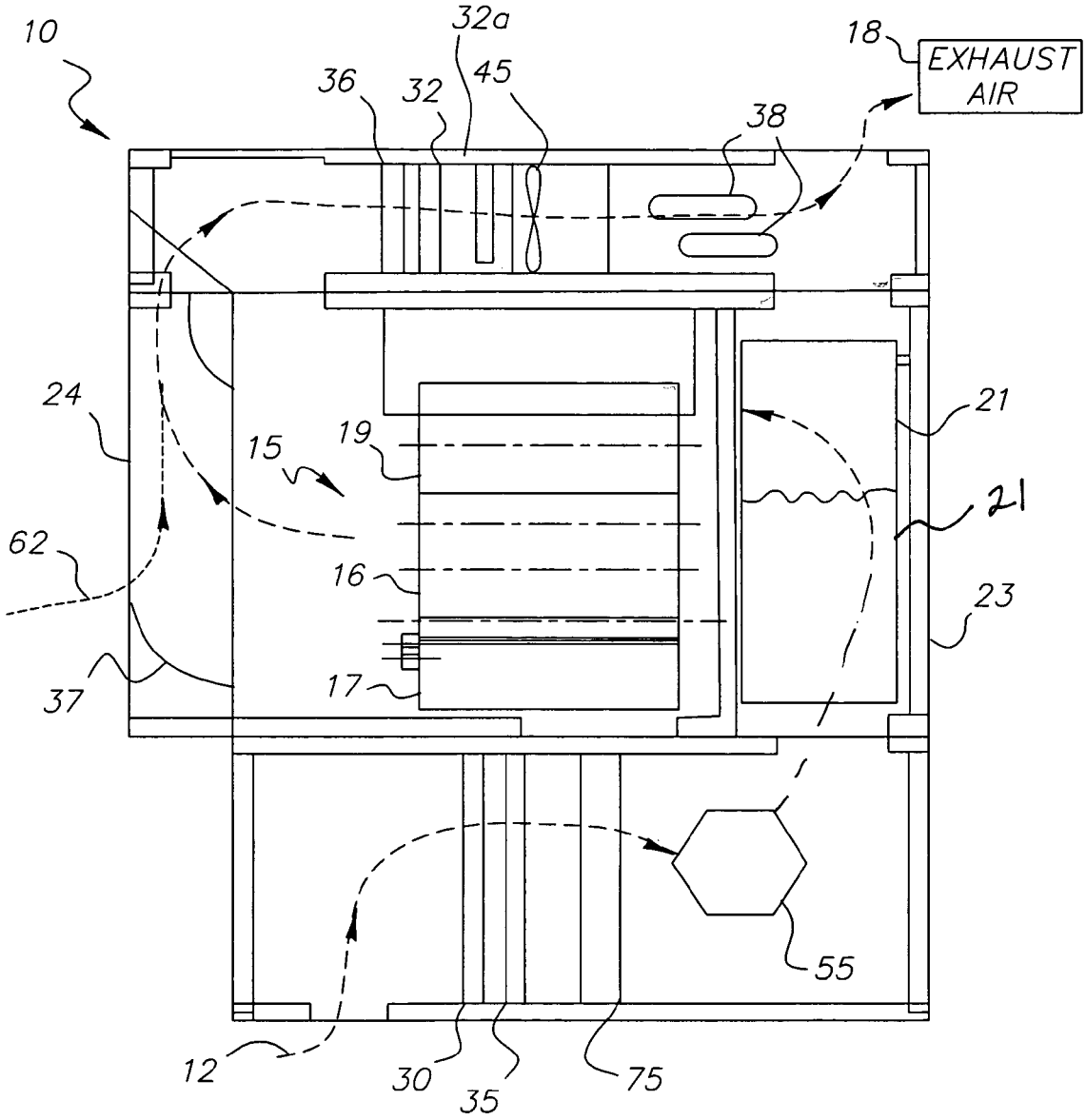
FIG. 2 is a side elevation view of the printer apparatus of FIG. 1.

With reference now to FIGS. 1 and 2, there is illustrated an exemplary printer apparatus or machine in this regard shown as an electrophotographic or xerographic reproducing apparatus 10 having an electrophotoconductive engine or module 15. As is well known with regard to such apparatus, an EP processor includes an electrophotoconductive recording member 16 that is uniformly electrostatically charged by a primary charger 14. The uniform electrostatic charge is then image wise modulated or selectively removed using an exposure device such as an LED or laser imaging device 11 or by optical exposure of the electrophotoconductive member to a document. The recording member with the remaining electrostatic charge is selectively developed by an electroscopic toner, from one or more development stations 17 that selectively develops the recording member in accordance with the charge remaining on the recording member. The developed toner image is then transferred to a recording sheet moving along a paper path 27. The recording sheet may be either paper or plastic and may be supplied in the form of a roll of continuous recording sheets or discrete sheets stored in one or more trays 22. The recording sheet with the developed image thereon is then passed through a fusing device 28 to fuse the image to the recording sheet. The recording sheet with the fused image thereon may be advanced so as to exit from the machine or collected in a tray or moved along the path 27A in which the sheet is turned over for recording a second image on the opposite side of the recording sheet. The recording member 16 may be in the form of a belt or drum and the toner image on the recording member may be either directly transferred to the recording sheet or one or more images, such as plural color toner images, may be collected on an intermediate transfer drum 19 and then transferred to the recording sheet as a composite multicolor image. Alternatively, the recording sheet may have transferred thereto, different color images to record a multicolor image. A cleaning device 26 may clean remnants of untransferred toner remaining on the recording member to prepare the recording member for recording each image.

Also shown in FIGS. 1 and 2 is an air flow inlet into which cooling air 12 is circulated into the apparatus and introduced from the bottom of the apparatus 10. The air flow then exits at the top of the machine shown in 18. With reference now to FIG. 2 a side elevation view of the apparatus 10 is shown and particularly illustrates in schematic form various components associated with the management of temperature and relative humidity within the apparatus 10. As best seen in FIG. 2 inlet air 12 enters a chamber and then is caused to be filtered by a particulate filter 30 for removal of dust particles and then by an amine filter 35; which, removes amine compounds in the air. The air then passes over a heating coil 75, which heats the air in accordance with an algorithm to be described below. The air stream is then subjected to passage through a mist humidifier 55, which includes water for increasing humidity to the air stream entering the EP engine. As may be seen in FIG. 2 the air stream is now positioned at the rear of the machine and is now caused to flow upwardly so as to flow over and provide cooling air to cool one or more electrical control board(s) 21 which provide electrical control of the EP process and the other components of the apparatus. The electrical control board(s) 21 is/are supported, so as to be vertically upstanding, by the back cover 23 of the apparatus 10. The board(s) 21 may comprise a spaced series of boards that are spaced to allow air to flow between them. (One of the boards is cut away to show the flow of air between them). The air stream is then moved transversely of the EP process path; i.e., crosswise of the main path of movement or rotation of the belt or drum, to cool or temperature modulate components of the EP process, such as the photoconductive drum or belt 16 and the associated exposure and/or charging stations associated therewith, the intermediate transfer roller 19 and the development station 17. The air stream also collects dust particles and ozone released as a result of the image forming process. The air stream then flows into a duct 37, formed integral with the front cover 24. The front cover is pivotably supported to the housing of the apparatus 10, so as to be openable by the machine operator or a technician for service. Preferably, the air duct 37, being integral with the front cover moves therewith when the front cover is opened. When the front cover door is in the closed position as shown the duct provides a passageway from the median portion of the machine to the top portion of the machine shown by the arrows. In the top portion of the machine the air stream is again subject to a filtration by a coarse filter 36, a fine filter 32, and an ozone filter 32*a* before entering the blower 45. This latter filtration protects the blower from contamination by toner collected through movement of the air stream through the machine and also reduces the particulate matter exiting the machine via the air stream. The air stream when exiting the blower 45 is then caused to pass over temperature and relative humidity sensors 38 and then exits the machine or apparatus as exhausted air at 18.

The air stream path described above has several advantages. Firstly, when the front cover or door 24 is opened to provide access to a serviceperson for service to the EP processor components the air stream path will be from where the air enters at the front door and then upwardly. Thus the air flow will not be in the case of a front cover or door opened condition as shown in FIG. 2 with the dashed arrow but will instead be in accordance with the dotted arrow 62. Thus, the flow of air at the opened front cover will be substantial movement of outside air into the apparatus and away from the service person, which may include the operator, and will not provide contaminated air that is coming from the EP process stations into the face of the operator. The above is also true if the back cover 23 is opened. A second advantage is that the air stream path being transverse to the EP process causes less disruption to that process in terms of dislodging or otherwise adversely affecting the image creation process.

Figure 3:
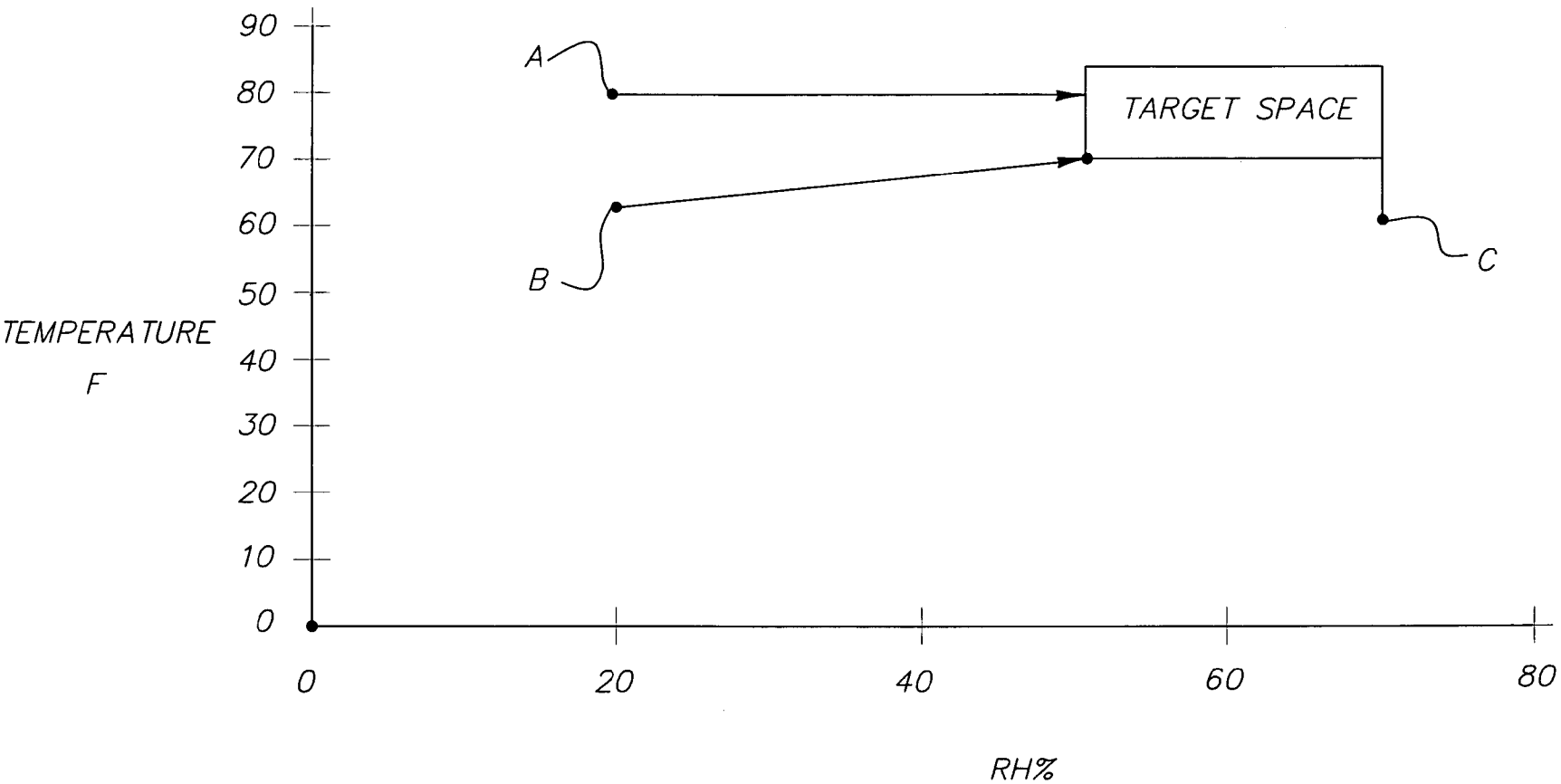
FIG. 3 is a graph illustrating a temperature and relative humidity area of set points for control of temperature and relative humidity in the machine of FIG. 1 in accordance with the invention.

With reference now to FIG. 3 there is shown a graph of temperature vs. relative humidity, which comprises the potential operating space for these parameters in operation of the apparatus. An area identified as "target space" identifies an area of acceptable combinations of temperature and relative humidity for operation of the apparatus. In FIG. 3 there are shown selected operating points A, B, and C that are outside of the optimal target space. These may represent possible operating points that require adjustment in order for the machine to be operating within the optimal target space. As may be seen with regard to point A the minimum change needed to move into the target space is to increase relative humidity from 20 percent to about 50 percent without the need to change temperature. This may be accomplished by turning on the mist humidifier 55. In the example where the current operating temperature and humidity is at point B and minimum change needed to be operating within the target space is to increase relative humidity from about 20 percent to 50 percent and to increase temperature from 60 degrees Fahrenheit to 70 degrees Fahrenheit. In the example of the current operating condition of point C, the minimum change needed to be operating within the target space is to increase temperature from 60 degrees Fahrenheit to 70 degrees Fahrenheit without increasing the relative humidity. It will be understood that since the humidity of the air within the machine changes with temperature that even though no change in relative humidity is required that some use of the mist humidifier will be required in order to maintain the relative humidity at the elevated temperature. It will further be appreciated that by not providing a single separate set point for each of temperature and relative humidity that great savings in controls necessary to maintain the environmental conditions within the machine are realized because of the tie-in between temperature and humidity.

Figure 4:
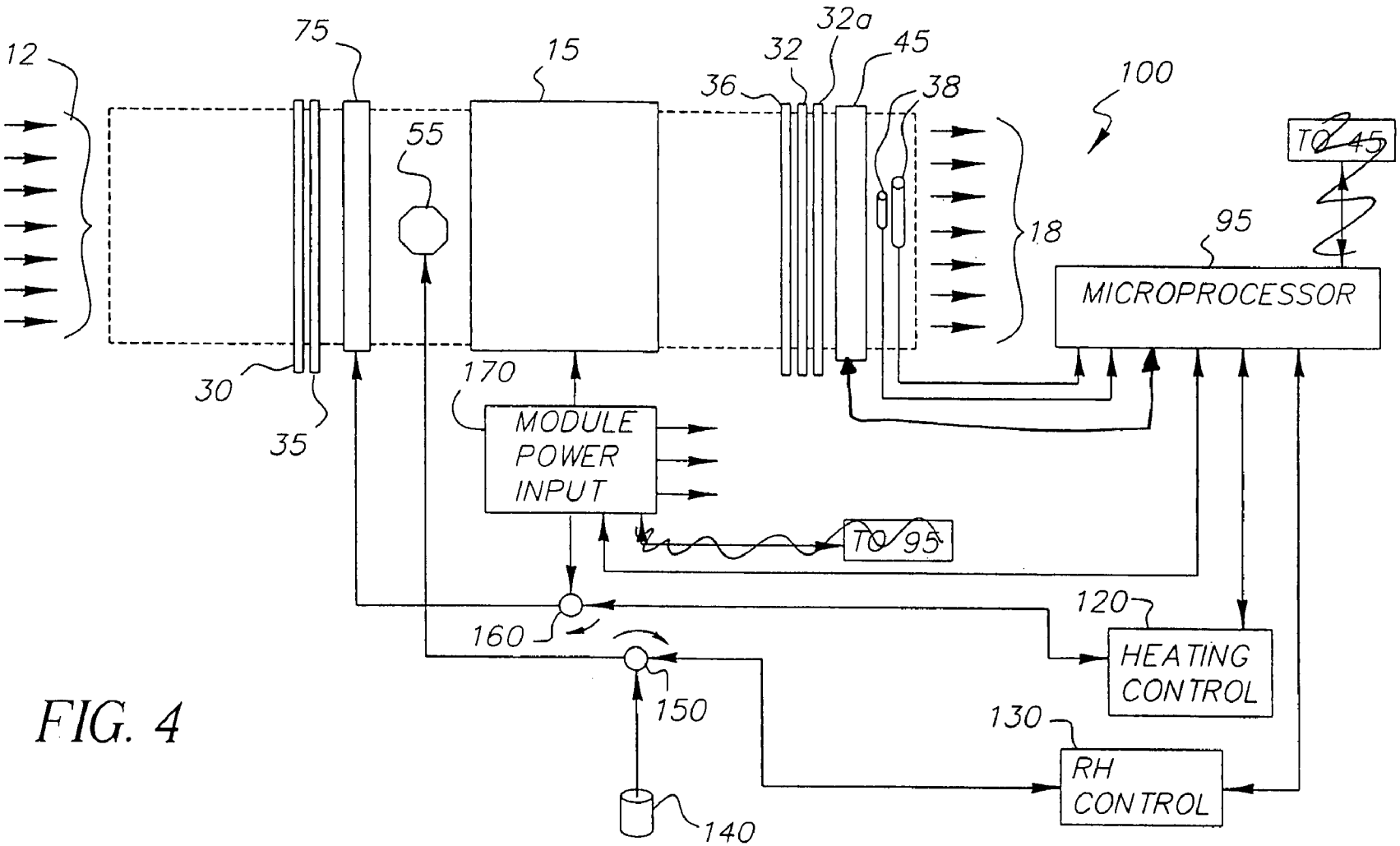
FIG. 4 is a control diagram illustrating the control elements associated with the printer apparatus of FIG. 1 and in accordance with the invention.

With reference now to FIG. 4 there is shown a control diagram of movement of the air stream through various stations. The inlet air 12 enters the machine through the bottom of the machine as noted previously and is subject to filtration by particulate filter 30 and amine filter 35. The air stream then passes over a heating coil 75 where it may be heated assuming that the heating coil is enabled by a heating control unit 120. The heating control unit 120 may in turn control a rheostat or other variable regulator of electrical energy, which may include solid-state devices. Power to the heating coil is provided by a power input module 170, which provides the input electrical power for all the electrical requirements for the machine including the EP module. The air stream then passes over the mist humidifier 55, which is supplied with water from the water line 140 having a water filter. A valve or other mist regulator 150 may be provided to control the mist humidifier 55. The mist regulator 150 may also include an electrically operated mechanical device, which rotates to create mist. The mist regulator, in turn, is controlled by a relative humidity control unit 130; which may receive periodic control signals from the microprocessor 95 to operate the mist humidifier. Subsequently to being heated and subjected to the addition of moisture in the air stream, the air stream passes through the EP module 15 to provide the correct conditions of temperature and moisture to the components of the EP module. After passing through the EP module the air stream is subjected to filtration (filters 36, 32) again to remove contaminants swept up during passage through the EP module. The air stream is then subjected to being sensed by temperature and relative humidity sensors 38 before being exited from the machine at exit 18. This may be seen in the diagram of FIG. 4 and only one blower fan 45 may be needed to pull air into the machine and exit same from the top at exit 18. When the front cover door is opened for maintenance of the EP processor components by the service person, the blower 45 may be on to cause air to flow as illustrated by dotted line 62 in FIG. 2.

Figure 5:
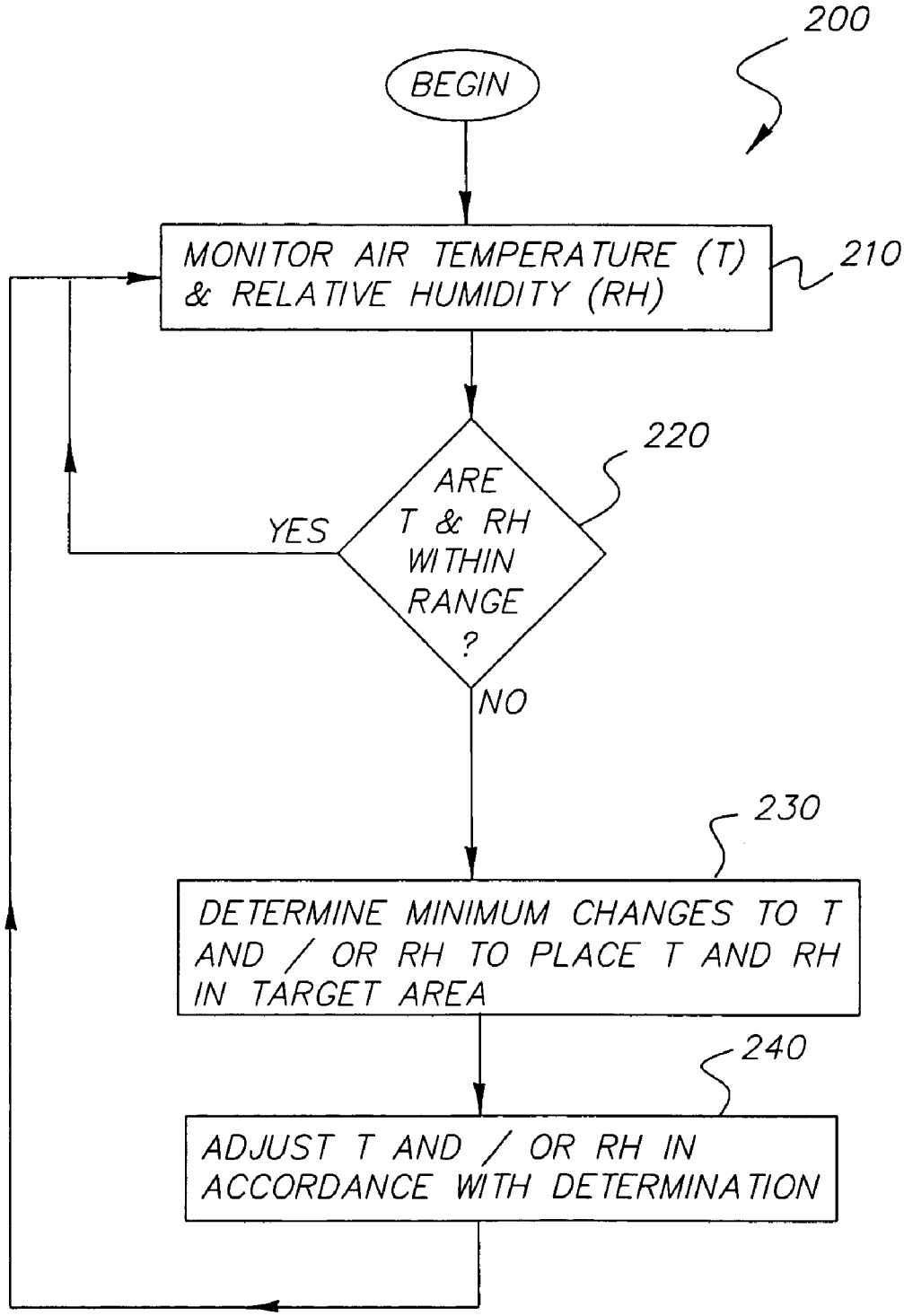
FIG. 5 is a flowchart illustrating operation of a programmed control for controlling operation of a heater and a mist-producing device to control temperature and relative humidity within the printer apparatus of FIG. 1 in accordance with the invention.

With reference now to the flowchart 200 of FIG. 5 in step 210, temperature (T) and humidity, preferably relative humidity (RH) are sensed by sensors 38 and signals representing same are communicated to the microprocessor 95. In step 220 the microprocessor determines whether or not the temperature and relative humidity are within the target space. As noted above the target space is generally a predetermined area in the temperature, relative humidity coordinate space and may be represented and stored in memory by values defining the boundaries thereof. For example, in the illustration of FIG. 3, the target space is represented by an area wherein the relative humidity is from about 50 percent to 70 percent and the temperature is in the range of 70 degrees Fahrenheit to 84 degrees Fahrenheit. Of course, other areas, and not necessarily rectangular ones, may be used to define the target space. If both temperature and relative humidity are within the ranges defined by the target space, no additional heating or additions of moisture to the air stream are needed. However, if the determination in step 220 is that a change is needed to temperature and/or relative humidity to place both the temperature and relative humidity in the target area or space then, depending upon the current condition of temperature and relative humidity and the minimum change needed to reach target space, temperature and/or relative humidity may be changed or adjusted in accordance with the determination, step 240. The changes or adjustments are implemented by the microprocessor 95 controlling the heating control unit 120 and the relative humidity control unit 130 which in turn control the various mechanical and/or electrical devices 150, 160 associated with heating coil 75 and mist humidifier 55.

Although the invention has been described with reference to an electrophotographic engine for printing, other printers may make use of the invention. For example, photographic printers, electrostatographic printers, inkjet printers, thermal printers and other printers requiring control of temperature and relative humidity. The term "process direction" is generally well known and implies a direction of a paper path or movement of an imaging member such as a photoconductive belt or drum. In addition although description has provided with regard to sensing temperature of the air stream, it will be understood that temperatures of various components of the EP process may be measured and determination made based on a temperature of a certain component or a certain combination of components.

The invention has been described in detail with particular reference to certain preferred embodiments thereof, but it will be understood that variations and modifications can be effected within the spirit and scope of the invention.

PARTS LIST

10 Reproducing apparatus

11 Imaging device

12 Air flow

14 Primary charger

15 EP engine

16 Electrophotoconductive recording member

17 Toner development stations

18 Air flow exit

19 Intermediate transfer drum

21 Electrical control board(s)

22 Receiver member (paper) supplies

23 Back cover

24 Front cover

26 Cleaning device

27 A return path for receiver member

28 Fusing station

30 Particulate filter

32 Fine filter

32*a* Ozone filter

35 Amine filter

36 Coarse filter

37 Air duct

38 Temperature and relative humidity sensors

45 Blower

55 Mist humidifier

62 Alternate air path flow (front cover door open)

75 Heating coil

95 Microprocessor controller

120 Heating control unit

130 Relative humidity control unit

140 Water line with water filter

150 Water valve

170 EP module power input

What is claimed is:

1. A printer apparatus comprising:

a print engine that is operative upon an article to be printed to impart markings upon the article; a fan mounted in said printing apparatus to provide air flow therein; a mist producing device for adding humidity in said printer apparatus to air moving within said printing apparatus; a sensor for detecting humidity within the printer apparatus; a heater for heating air moving within said printer apparatus; a sensor for detecting temperature within the printer apparatus; and a controller for determining if the detected humidity within the apparatus falls within a range of acceptable humidities and the detected temperature within the apparatus falls within a range of acceptable temperatures and provides control of the heater and the mist producing device for control of temperature and humidity within the apparatus; wherein the range of acceptable humidities and acceptable temperatures defines an area of set points of acceptable humidities and temperatures; and wherein while said print engine prints on an article moved in a process direction, said fan provides an air flow across said article in a direction transverse to the process direction.

2. The printer apparatus of claim 1 wherein said controller includes a microprocessor that is programmed such that, when the present detected temperature and/or humidity is outside of the area range of acceptable temperatures and humidities, determines a minimum change in a combination of temperature and relative humidity adjustments needed to change the temperature and humidity within the apparatus and in accordance with such determination controls which of the heater and the mist producing device or both is/are to be operated to provide the minimum change needed to change the present temperature and humidity to a temperature and humidity that is inside of the area range of acceptable temperatures and humidities.

3. A method of controlling conditions in a printer apparatus that includes a print engine that is operative upon an article to print marks upon the article, the method comprising:

detecting humidity within the printer apparatus;

detecting temperature within the printer apparatus;

determining if the detected humidity within the apparatus falls within a range of acceptable humidities and the detected temperature within the apparatus falls within a range of acceptable temperatures wherein the range of acceptable humidities and acceptable temperatures defines an area of set points of acceptable humidities and temperatures; and while a recording member is moved in a process direction, air flow is provided across the recording member in a direction transverse to the process direction.

4. The method of claim 3 wherein when the present detected temperature and relative humidity are outside of the area range of acceptable temperatures and humidities, a minimum change in a combination of temperature and humidity adjustments needed to change the temperature and humidity within the apparatus is determined, and in accordance with such determination the minimum change needed to change the present temperature and humidity to a temperature and humidity that is inside of the area range of acceptable temperatures and humidities is accomplished.

5. The method of claim 3 wherein the printer apparatus has temperature and humidity controlled without use of a refrigeration unit.

* * * * *